US005819493A

United States Patent [19]

LeMoignan

[11] Patent Number: 5,819,493

[45] Date of Patent: Oct. 13, 1998

[54] HEIGHT ADJUSTABLE REBAR SUPPORT SYSTEM

[76] Inventor: Michael LeMoignan, 11885 River Road, Surrey BC, Canada, V3V 2V9

[21] Appl. No.: 806,251

[22] Filed: Feb. 21, 1997

[51] Int. Cl.[6] ..... E04C 5/16

[52] U.S. Cl. ..... 52/678; 40/610; 52/684; 52/689; 248/174; 404/136

[58] Field of Search ..... 40/610, 755, 756; 52/677, 678, 684, 687, 689; 248/166, 174; 404/135, 136; D8/354, 355, 373, 380

[56] References Cited

U.S. PATENT DOCUMENTS

| | | | |
|---|---|---|---|
| 1,058,908 | 4/1913 | Schoenthaler | 52/687 |
| 1,115,021 | 10/1914 | Pummill | 40/610 |
| 1,495,659 | 5/1924 | Williamson | 52/677 |
| 4,253,260 | 3/1981 | Maza et al. | 40/610 |
| 4,953,340 | 9/1990 | Anderson | 404/136 X |
| 5,358,762 | 10/1994 | McGrath | 40/610 X |

*Primary Examiner*—Carl D. Friedman
*Assistant Examiner*—Kevin D. Wilkens

[57] ABSTRACT

A new Height Adjustable Rebar Support System for supporting rebar at various elevations during pouring and curing of concrete with a single adjustable support member. The inventive device includes a first panel having a first lower slot, a second panel pivotally attached to the first panel having a second lower slot, an aperture and a notch into the first panel near the first lower slot, and a beaded cord secured to the second panel. The end of the beaded cord opposite of the second panel selectively engages the first panel through the aperture thereby adjusting the separation of the first panel with respect to the second panel opposite of the pivoting point. The beaded cord comprises a plurality of color coded beads for indicating the exact height selected with a selected color of bead juxtaposed to the first panel within the aperture.

9 Claims, 3 Drawing Sheets

HEIGHT ADJUSTABLE REBAR SUPPORT SYSTEM

BACKGROUND OF THE INVENTION

1. Field of the Invention

The present invention relates to Rebar Support Devices and more particularly pertains to a new Height Adjustable Rebar Support System for supporting rebar at various elevations during pouring and curing of concrete with a single adjustable support member.

2. Description of the Prior Art

The use of Rebar Support Devices is known in the prior art. More specifically, Rebar Support Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Rebar Support Devices include U.S. Pat. No. 4,835,933; U.S. Pat. 4,996,816; U.S. Pat. No. Des. 264,682; U.S. Pat. No. 4,655,023; U.S. Pat. No. 4,899,515 and U.S. Pat. No. 4,915,346.

While these devices fulfill their respective, particular objectives and requirements, the aforementioned patents do not disclose a new Height Adjustable Rebar Support System. The inventive device includes a first panel having a first lower slot, a second panel pivotally attached to the first panel having a second lower slot, an aperture and a notch into the first panel near the first lower slot, and a beaded cord secured to the second panel.

In these respects, the Height Adjustable Rebar Support System according to the present invention substantially departs from the conventional concepts and designs of the prior art, and in so doing provides an apparatus primarily developed for the purpose of supporting rebar at various elevations during pouring and curing of concrete with a single adjustable support member.

SUMMARY OF THE INVENTION

In view of the foregoing disadvantages inherent in the known types of Rebar Support Devices now present in the prior art, the present invention provides a new Height Adjustable Rebar Support System construction wherein the same can be utilized for supporting rebar at various elevations during pouring and curing of concrete with a single adjustable support member.

The general purpose of the present invention, which will be described subsequently in greater detail, is to provide a new Height Adjustable Rebar Support System apparatus and method which has many of the advantages of the Rebar Support Devices mentioned heretofore and many novel features that result in a new Height Adjustable Rebar Support System which is not anticipated, rendered obvious, suggested, or even implied by any of the prior art Rebar Support Devices, either alone or in any combination thereof.

To attain this, the present invention generally comprises a first panel having a first lower slot, a second panel pivotally attached to the first panel having a second lower slot, an aperture and a notch into the first panel near the first lower slot, and a beaded cord secured to the second panel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of tile components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including Such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Height Adjustable Rebar Support System apparatus and method which has many of the advantages of the Rebar Support Devices mentioned heretofore and many novel features that result in a new Height Adjustable Rebar Support System which is not anticipated, rendered obvious, suggested, or even implied by any of the prior art Rebar Support Devices, either alone or in any combination thereof.

It is another object of the present invention to provide a new Height Adjustable Rebar Support System which may be easily and efficiently manufactured and marketed.

It is a further object of the present invention to provide a new Height Adjustable Rebar Support System which is of a durable and reliable construction.

An even further object of the present invention is to provide a new Height Adjustable Rebar Support System which is susceptible of a low cost of manufacture with regard to both materials and labor, and which accordingly is then susceptible of low prices of sale to the consuming public, thereby making such Height Adjustable Rebar Support System economically available to the buying public.

Still yet another object of the present invention is to provide a new Height Adjustable Rebar Support System which provides in the apparatuses and methods of the prior art some of the advantages thereof, while simultaneously overcoming some of the disadvantages normally associated therewith.

Still another object of the present invention is to provide a new Height Adjustable Rebar Support System for supporting rebar at various elevations during pouring and curing of concrete with a single adjustable support member.

Yet another object of the present invention is to provide a new Height Adjustable Rebar Support System which includes a first panel having a first lower slot, a second panel pivotally attached to the first panel having a second lower slot, an aperture and a notch into the first panel near the first lower slot, and a beaded cord secured to the second panel.

Still yet another object of the present invention is to provide a new Height Adjustable Rebar Support System that may be stored in a swaged formation on top of one another thereby saving storage space during transportation of the present invention.

Even still another object of the present invention is to provide a new Height Adjustable Rebar Support System that prevents costly stoppage of work on a construction project by always having the appropriate size of rebar support device.

Another object of the present invention is to provide a new Height Adjustable Rebar Support System that reduces the likelihood of an air pocket forming within the concrete because of its open sides.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
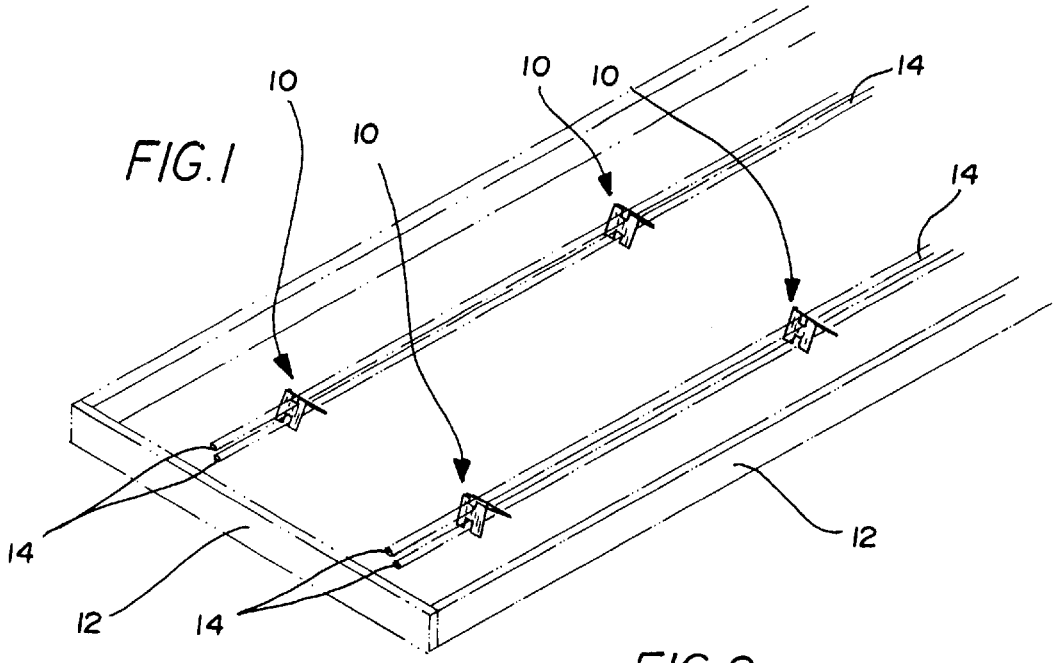
FIG. 1 is an upper perspective view of a new Height Adjustable Rebar Support System supporting rebar according to the present invention.

With reference now to the drawings, and in particular to FIGS. 1 through 6 thereof, a new Height Adjustable Rebar Support System embodying the principles and concepts of the present invention and generally designated by the reference numeral 10 will be described.

Figure 2:
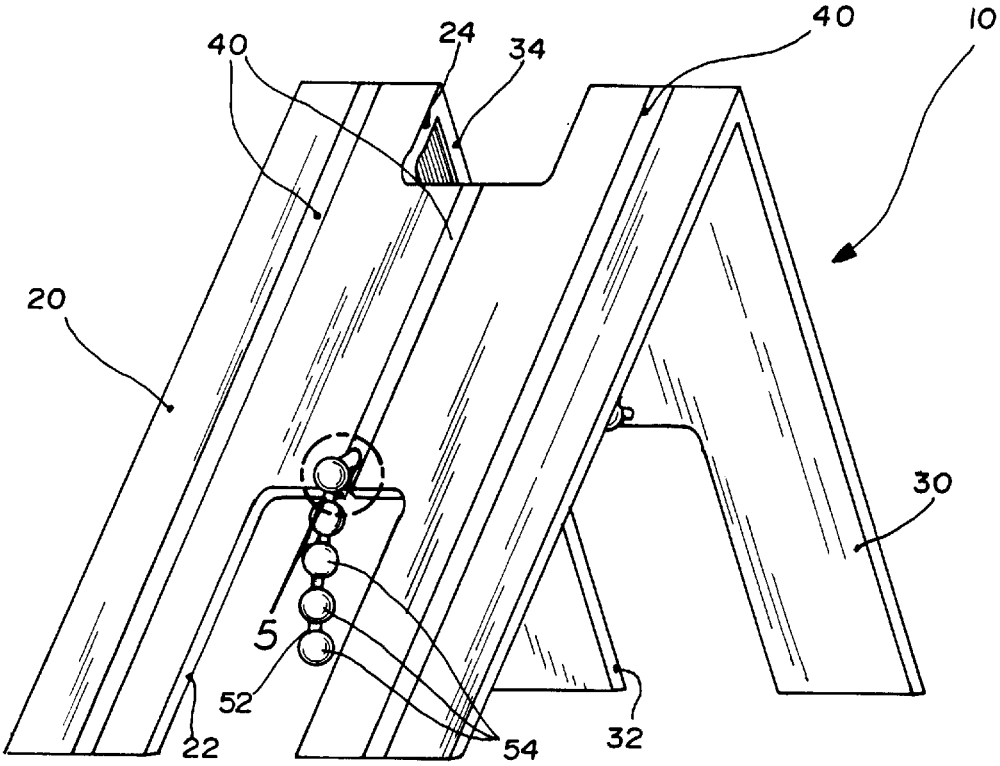
FIG. 2 is an upper side perspective view of the present invention.
Figure 3:
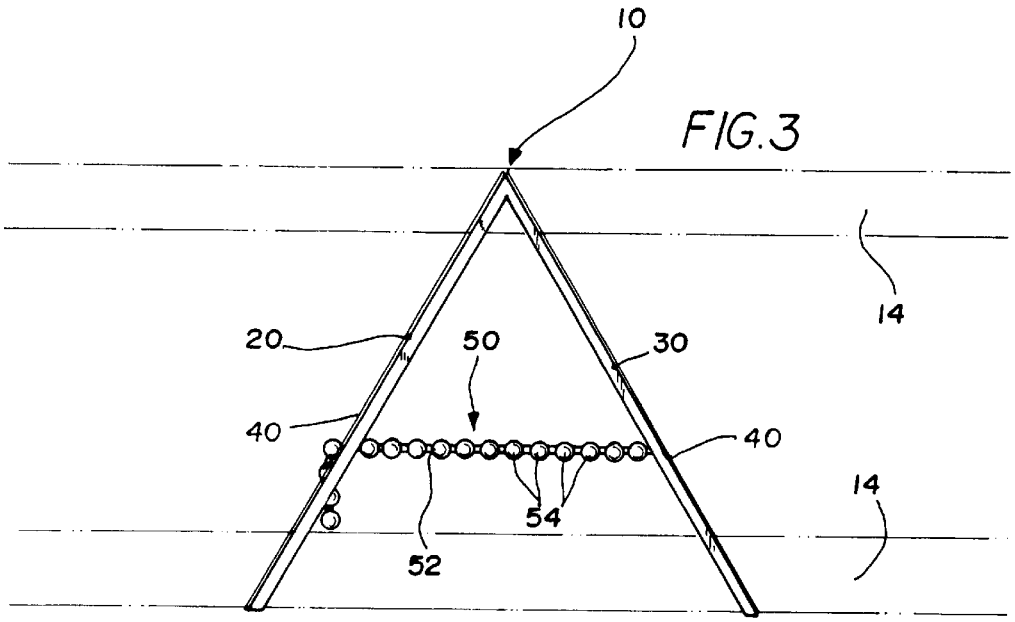
FIG. 3 is a side view of the present invention supporting rebar at a selected elevation.
Figure 4:
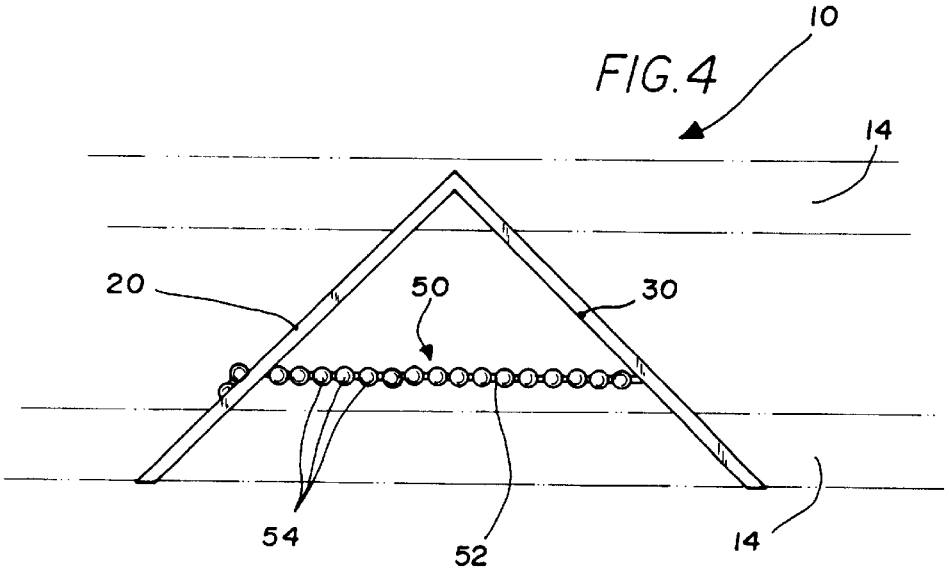
FIG. 4 is a side view of the present invention supporting rebar at a lower elevation than from FIG. 3.

More specifically, it will be noted that the Height Adjustable Rebar Support System 10 comprises a first panel 20 having a first lower slot 22 and a first upper slot 24 forming an H-shape. A second panel 30 is pivotally attached to the first panel 20 adjacent the first upper slot 24 as best shown in FIGS. 1 through 4 of the drawings. The second panel 30 has a second lower slot 32 and a second upper slot 34 corresponding to the first lower slot 22 and the first upper slot 24 of the first panel as best shown in FIG. 2 of the drawings. The first lower slot 22 and the second lower slot 32 are for surrounding the length of rebar 14 juxtaposed to ground. The first upper slot 24 and the second upper slot 34 are for removably receiving and supporting a length of rebar 14 at a selected height. A width adjusting means 50 is removably secured mesial the first panel 20 and the second panel 30 opposite of the first upper slot 24 and the second upper slot 34 for allowing adjustment of the separation of the first panel 20 with respect to the second panel 30. The width adjusting means 50 allows adjustment of the elevation of the rebar 14 positioned within the first upper slot 24 and the second upper slot 34 as shown in FIGS. 3 and 4 of the drawings.

Figure 5:
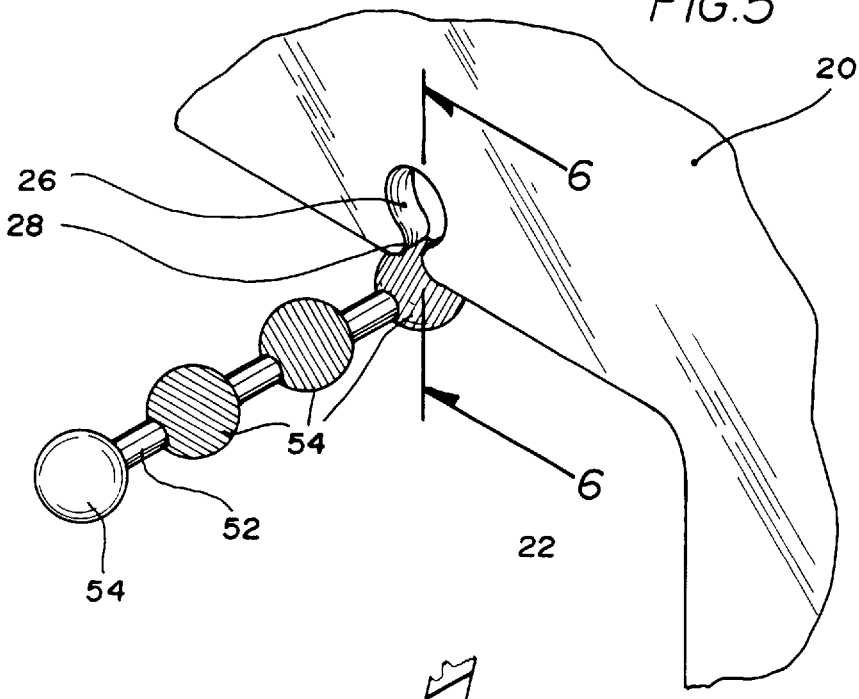
FIG. 5 is a magnified upper perspective cutaway view of the aperture and notch receiving the color coded beaded cord.
Figure 6:
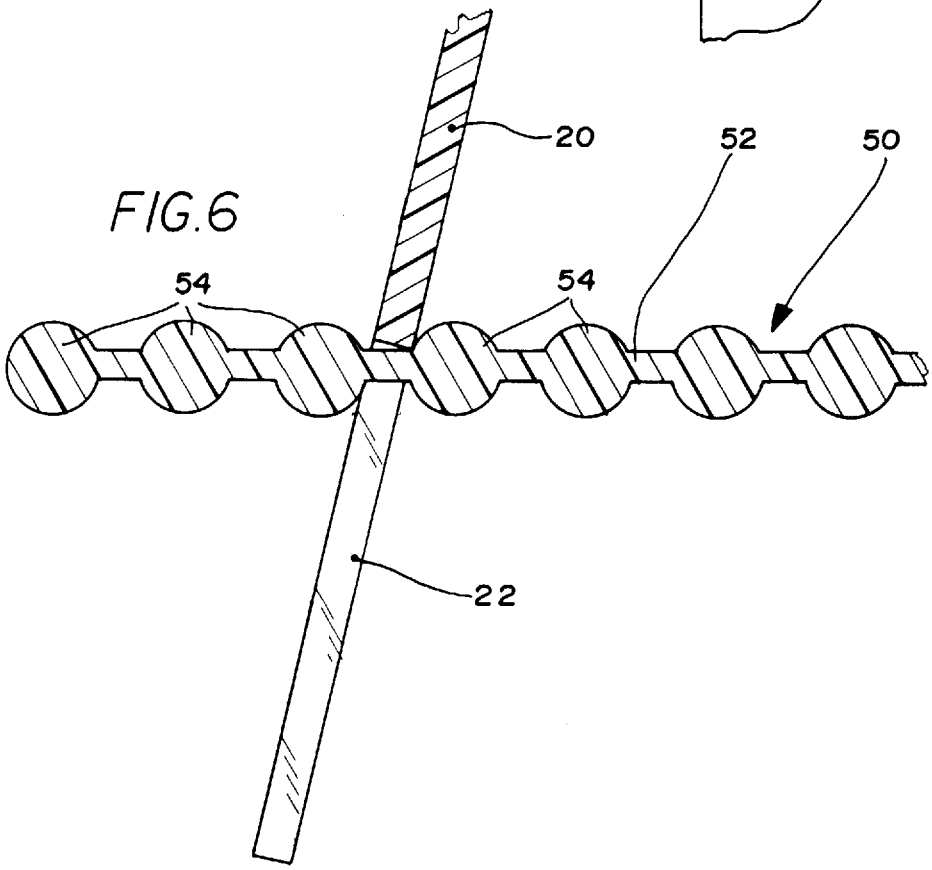
FIG. 6 is a cross sectional view taken along line 6—6 of FIG. 5.

As shown in FIGS. 2 through 6 of the drawings, the width adjusting means 50 comprises a notch 28 projecting from within the first lower slot 22 into the first panel 20 a finite distance. An aperture 26 projects through the first panel 20 and is connected to the notch 28. The diameter of the aperture 26 is substantially greater than a width of the notch 28 as shown in FIG. 5 of the drawings. A beaded cord 52 is secured at one end to a lower portion of the second panel 30. An end of the beaded cord 52 opposite of the second panel 30 selectively engages the aperture 26 by projecting through the notch 28 allowing for the control of the width of the first panel 20 with respect to the second panel 30. The beaded cord 52 preferably comprises a plurality of color coded beads 54 which are larger in diameter than the aperture 26. Each color of the color coded beads 54 indicates a predetermined elevation which will be achieved for the rebar 14 within the first upper slot 24 and the second upper slot 34 when a selected color coded bead 54 is positioned within the aperture 26. The first panel 20 and the second panel 30 are preferably constructed from a rigid lightweight plastic.

As shown in FIG. 2 of the drawings, at least one reinforcing rib 40 is secured to the first panel 20 and the second panel 30 for increasing the amount of load the first panel 20 and the second panel 30 are able to support during operation. The reinforcing rib 40 preferably projects parallel to a longitudinal axis of said panels 20, 30. In use, the user lays a first layer of rebar 14 within a concrete form 12 juxtaposed to ground. The user then positions a plurality of the present invention upon the rebar 14 with the first and second lower slots 22, 32 surrounding the rebar 14 juxtaposed to the ground. The user adjusts the height of the present invention by selecting the proper color coded bead 54 which represents the proper elevation that a second layer of rebar 14 is supposed to be at. The selected color coded bead 54 is positioned juxtaposed to the first panel 20 within the aperture 26. The tension of the beaded cord 52 retaining the proper width of the first panel 20 and the second panel 30 retains the selected color coded bead 54 within the aperture 26 of the first panel 20, thereby preventing accidental removal of the selected color coded bead 54. When the present invention is not in use, the first panel 20 may be positioned juxtaposed to the second panel 30 thereby allowing stacking of a plurality of the present invention into a compact storage pile.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A height adjustable concrete reinforcing bar support system for supporting a length of concrete reinforcing bar, said system comprising:

a first panel having a first upper slot for receiving a portion of the length of a concrete reinforcing bar;

a second panel pivotally attached to said first panel at a location of pivotal attachment adjacent to said first upper slot;

said second panel having a second upper slot generally corresponding to the first upper slot of said first panel;

a width adjusting means for adjusting the angle orientation of said first panel with respect to said second panel to thereby adjust the relative elevation of a reinforcing bar placed in said first and second upper slots; and wherein said width adjusting means includes a notch in one of said panels at a location spaced from the location of pivotal attachment of said first and second panels, and a beaded cord secured at one end to said second panel at a location spaced from the location of pivotal attachment of said first and second panels, wherein an end of said beaded cord opposite of said second panel is insertable into said notch to adjust the effective length of said beaded cord between said first and second panels.

2. A height adjustable rebar support system comprising:

a first panel having a first lower slot and a first upper slot forming an H-shape;

a second panel pivotally attached to said first panel adjacent said first upper slot;

said second panel having a second lower slot and a second upper slot corresponding to said first lower slot and said first upper slot, wherein said first lower slot and said second lower slot are for surrounding said length of rebar juxtaposed to ground and wherein said first upper slot and said second upper slot are for removably receiving and supporting a length of rebar;

a width adjusting means removably secured mesial said first panel and said second panel opposite of said first upper slot and said second upper slot for allowing adjustment of the separation of said first panel with respect to said second panel thereby allowing adjustment of the elevation of said rebar positioned within said first upper slot and said second upper slot; and wherein said width adjusting means includes a notch projecting from within said first lower slot into said first panel a finite distance;

an aperture projecting through said first panel and connected to said notch, wherein a diameter of said aperture is substantially greater than a width of said notch; and a headed cord secured at one end to a lower portion of said second panel, wherein an end of said beaded cord opposite of said second panel selectively engages said aperture by projecting through said notch allowing for the control of the width of said first panel with respect to said second panel.

3. The height adjustable rebar support system of claim 2, wherein said beaded cord comprises a plurality of color coded beads larger in diameter than said aperture, wherein each color indicates a predetermined elevation which will be achieved for rebar within said first tipper slot and said second upper slot when a selected color coded bead is positioned within said aperture.

4. The height adjustable rebar support system of claim 2, wherein at least one reinforcing rib is secured to said first panel and said second panel for increasing the amount of load said first panel and said second panel are able to support during operation.

5. The height adjustable rebar support system of claim 2, wherein said first panel and said second panel are constructed from a rigid lightweight plastic.

6. In combination, a height adjustable rebar support system; and a first and a second length of rebar;

wherein the rebar support system comprises a first panel having a first lower slot and a first upper slot forming an H-shape;

a second panel pivotally attached to said first panel adjacent said first upper slot;

said second panel having a second lower slot and a second upper slot corresponding to said first lower slot and said first upper slot, said first and second upper slots receiving the first length of rebar and said first and second lower slots receiving the second length of rebar such that the first length of rebar is held spaced above the second length of rebar; and a width adjusting means removably secured between said first panel and said second panel opposite of said first upper slot and said second upper slot for allowing adjustment of the separation of said first panel with respect to said second panel thereby allowing adjustment of the elevation of said first length of rebar positioned within said first and second upper slots with respect to the second length of rebar positioned in said first and second lower slots;

wherein said width adjusting means comprises:

a notch projecting from within said first lower slot into said first panel a finite distance;

an aperture projecting through said first panel and connected to said notch, wherein a diameter of said aperture is substantially greater than a width of said notch; and a beaded cord secured at one end to a lower portion of said second panel, wherein an end of said beaded cord opposite of said second panel selectively engages said aperture by projecting through said notch allowing for the control of the width of said first panel with respect to said second panel.

7. The height adjustable rebar support system of claim 6, wherein said beaded cord comprises a plurality of color coded beads larger in diameter than said aperture, wherein each color indicates a predetermined elevation which will be achieved for rebar within said first upper slot and said second upper slot when a selected color coded bead is positioned within said aperture.

8. The height adjustable rebar support system of claim 6, wherein at least one reinforcing rib is secured to said first panel and said second panel for increasing the amount of load said first panel and said second panel are able to support during operation.

9. The height adjustable rebar support system of claim 6, wherein said first panel and said second panel are constructed from a rigid lightweight plastic.

* * * * *